US006471081B1

(12) United States Patent
Weiler

(10) Patent No.: US 6,471,081 B1
(45) Date of Patent: Oct. 29, 2002

(54) ADJUSTABLE BOOKEND

(76) Inventor: Raywood C. Weiler, 14149 Calle Contesa, Victorville, CA (US) 92392-5489

( * ) Notice: Subject to any disclaimer, the term of this patent is extended or adjusted under 35 U.S.C. 154(b) by 0 days.

(21) Appl. No.: 09/553,262

(22) Filed: Apr. 20, 2000

(51) Int. Cl.[7] ..... A47F 5/00; A47B 65/00

(52) U.S. Cl. ..... 211/184; 211/43

(58) Field of Search ..... 211/42, 43, 59.4, 211/11, 184; 108/60, 61; 248/441.1, 447.2, 448, 453, 454, 412, 222.13, 222.14, 229.11, 229.16, 229.21, 229.26, 228.2, 228.7, 231.31

(56) References Cited

U.S. PATENT DOCUMENTS 546,570 A * 9/1895 Young
607,890 A * 7/1898 Smith
607,891 A * 7/1898 Smith
903,769 A * 11/1908 Poindexter ..... 248/441.1
1,198,186 A * 9/1916 Brown ..... 211/42
1,395,825 A * 11/1921 Hoffman ..... 248/229.16
1,806,642 A * 5/1932 Ohnstrand
2,056,683 A * 10/1936 Mattman ..... 211/11
2,946,457 A * 7/1960 Pierce et al.
3,106,376 A * 10/1963 Scott ..... 248/229.21
3,243,153 A * 3/1966 Kelly et al. ..... 248/229.26
3,501,019 A * 3/1970 Armstrong et al.
3,698,568 A * 10/1972 Armstrong ..... 211/184
3,703,964 A * 11/1972 Field ..... 211/184
3,746,295 A * 7/1973 Stepanek et al. ..... 248/229.16
4,327,838 A 5/1982 Cooke
4,775,058 A * 10/1988 Yatsko ..... 211/184
5,103,987 A * 4/1992 Davis ..... 211/43
5,217,124 A * 6/1993 Stone ..... 211/184
5,275,297 A * 1/1994 Dokoupil et al. ..... 211/184
5,295,596 A * 3/1994 Squitieri ..... 211/43
5,325,792 A * 7/1994 Mulloy ..... 211/42
5,381,908 A * 1/1995 Hepp ..... 211/184
5,582,305 A * 12/1996 Howell, Sr. et al. ..... 211/184
5,655,670 A * 8/1997 Stuart ..... 211/43
5,709,365 A * 1/1998 Howard ..... 248/454
6,044,982 A * 4/2000 Stuart ..... 211/43

* cited by examiner

*Primary Examiner*—Daniel P. Stodola
*Assistant Examiner*—Jennifer E. Novosad
(74) *Attorney, Agent, or Firm*—Marshall, Gerstein & Borun

(57) ABSTRACT

A bookend for use with a bookshelf includes an upright, a base adapted for placement generally adjacent the bookshelf upper surface, a lower portion depending from the base, and an adjustable securement mechanism. The lower portion cooperates with the base to define a capture area, and the capture area is sized to receive the bookshelf front edge portion. The adjustable securement mechanism is mounted to the lower portion and is adapted to secure the bookshelf front edge portion in the capture area, thus securing the bookend to the bookshelf.

23 Claims, 7 Drawing Sheets

ADJUSTABLE BOOKEND

FIELD OF THE INVENTION

The present invention relates to bookends for use on bookshelves. More particularly, the present invention relates to a clamp on bookend that positively and securely engages the bookshelf and that can be quickly and easily removed for relocation and re-attachment.

BACKGROUND OF THE INVENTION

On bookshelves it is highly desirable to have bookends in order to prevent the books supported thereon from falling off or tipping over. It is also desirable that the books be supported on a fully upright position rather than in a tilted position, which can warp the book by damaging the binding. These considerations are very important in institutional settings, where a large number of books are circulated on and off the shelves in a relatively short period of time. In such situations, it is desirable to have a bookend that can be quickly and easily moved on the shelf, and which firmly and positively supports the books which may lean against it. It is also desirable to have a bookend that is readily adaptable to a number of different shelf designs and that is readily adaptable to support books of varying height.

A number of clip on or clamp on bookends exist in the prior art, most of which suffer from one or more drawbacks. Accordingly, there exists a continuing need for an improved clamp on bookend for use with bookshelves.

SUMMARY OF THE INVENTION

According to one aspect of the invention, a bookend is provided for use with a bookshelf, with the bookshelf having an upper surface, a lower surface, and being bounded in part by a front edge portion. The bookend includes an upright, a base adapted for placement generally adjacent the bookshelf upper surface, a lower portion depending from the base, and an adjustable securement mechanism. The lower portion cooperates with the base to define a capture area, and the capture area is sized to receive the bookshelf front edge portion. The adjustable securement mechanism is-mounted to the lower portion and is adapted to positively secure the bookshelf front edge portion in the capture area, thus securing the bookend to the bookshelf.

In further accordance with a preferred embodiment, the securement mechanism includes a threaded rod rotatably mounted to the lower portion, and the securement mechanism is responsive to rotation of the threaded rod to thereby permit the application of a variable and progressively greater force against the bookshelf front edge portion. The securement mechanism may include a wedge member operatively coupled to the threaded rod.

Preferably, the lower portion includes a first leg and a second leg, with at least a portion of the second leg defining a camming surface. The threaded rod of the securement mechanism is rotatably mounted to the first leg, and a wedge member engages the threaded rod. The wedge member preferably is sized to coact with the camming surface in response to rotation of the threaded rod, thereby apply a progressively greater force against the bookshelf.

The base may include a pad positioned to contact the bookshelf upper surface, and the lower portion may include a pad positioned to contact the bookshelf front edge portion. The threaded rod is preferably secured to the lower portion by a clip, with the clip having an aperture sized to receive a portion of the threaded rod. The centering clip preferably comprises spring steel.

A plate member may be removably attached to the upright, with the plate member being attachable in a first position in which the plate member extends upwardly away from the bookshelf upper surface, and further being attachable in a second position in which the plate member extends downwardly toward the bookshelf upper surface.

The bookshelf front edge portion may include a downwardly depending flange which defines with the bookshelf lower surface an interior corner, and the securement mechanism may include a wedge member having an extending portion adapted to engage the interior corner. The securement mechanism further including a threaded rod rotatably mounted to the lower portion, with the wedge member being moveable in response to rotation of the threaded rod to thereby permit the wedge member extending portion to apply a progressively greater force against the bookshelf interior corner. The wedge member includes a threaded portion, and the extending portion of the wedge member is shiftable or pivotable relative to the threaded portion.

In accordance with another aspect of the invention, a bookend for use with a bookshelf includes a frame, a threaded rod rotatably mounted to the frame, and a wedge member. The frame includes a first portion adapted to overlie the bookshelf upper surface, and further includes a second portion depending from the first portion. The first and second portions cooperate to define a capture area, with the capture area being sized to receive therein a front edge portion of the bookshelf. At least a portion of the frame second portion defines a camming surface. The wedge member is adapted to engage the threaded rod, and the wedge member may be brought into contact with the bookshelf in response to rotation of the threaded rod, thereby positively securing the shelf front edge portion in the capture area.

In accordance with yet another aspect of the invention, a bookend for use with a bookshelf includes a frame, with the frame including a first portion adapted to overlie an upper surface of the bookshelf, and a second portion depending from the first portion. The frame first and second portions cooperate to define a capture area, with the capture area being sized to receive therein a front edge portion of the bookshelf. The frame second portion includes a camming surface. A securement mechanism includes a threaded rod rotatably mounted to the frame and a wedge member adapted to engage the threaded rod. The securement mechanism cooperates with the camming surface so as to apply a progressively greater securing force to the bookshelf in response to rotation of the threaded rod, thereby positively securing the bookend to the bookshelf.

These and other advantages and features of the present invention will become readily apparent to those skilled in the art upon a reading of the following description.

DETAILED DESCRIPTION OF THE PREFERRED EMBODIMENTS

Figure 1:
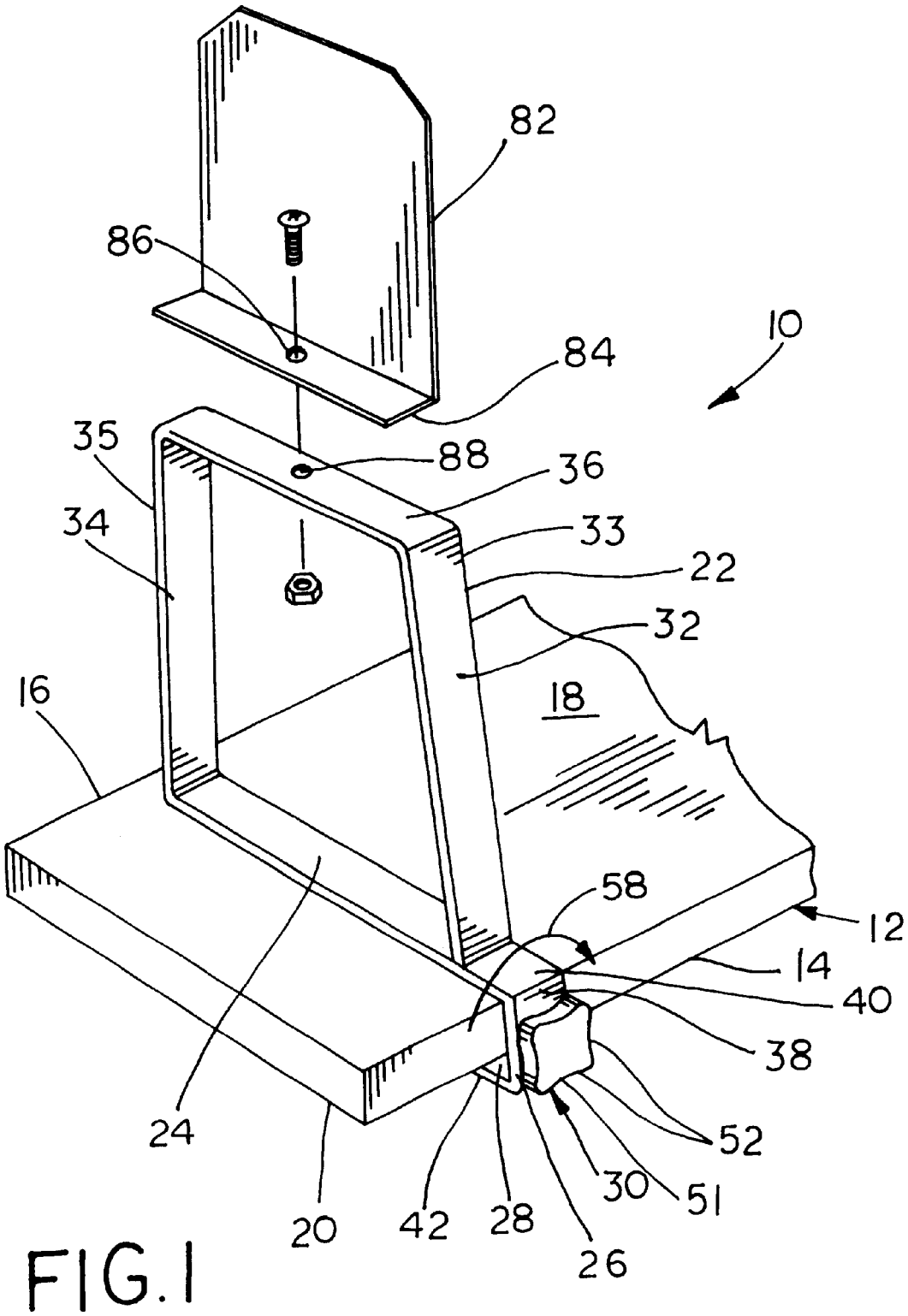
FIG. 1 is a perspective view of a bookend assembled in accordance with the teachings of the present invention and shown with an optional attachment for use therewith.
Figure 3:
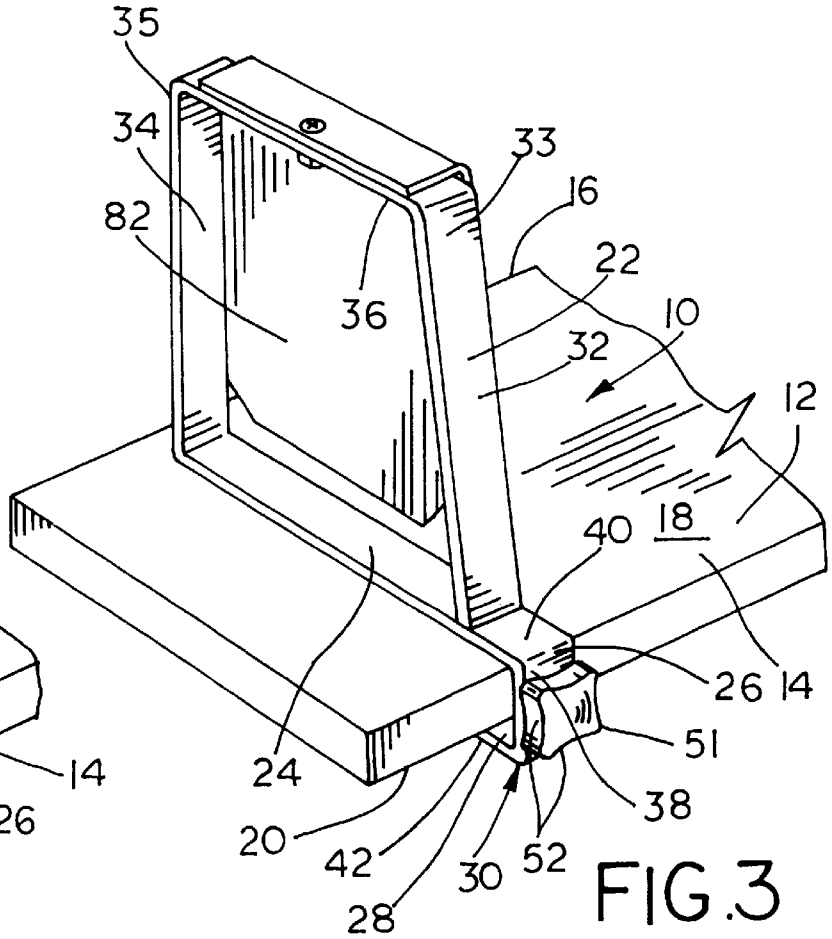
FIG. 3 is a perspective view similar to FIG. 2 but showing the attachment extending downwardly therefrom.
Figure 2:
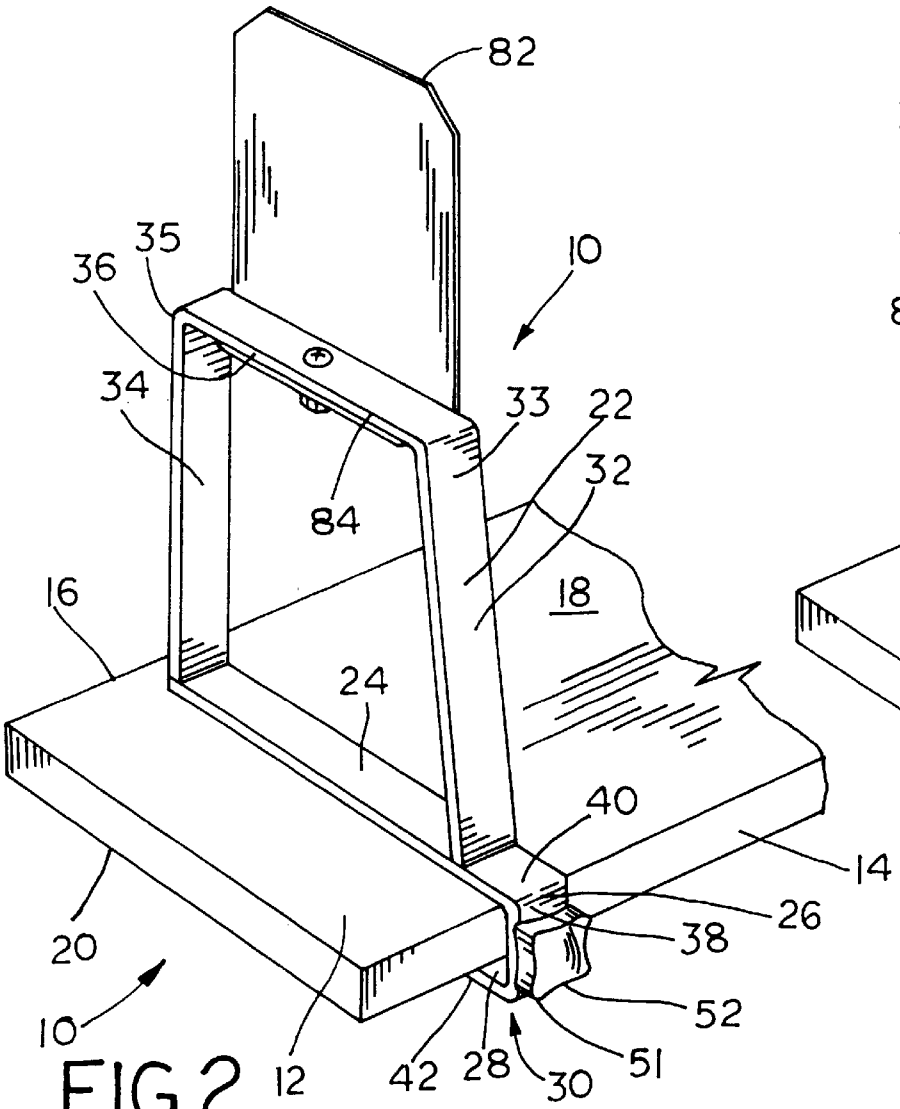
FIG. 2 is a perspective view similar to FIG. 1 but showing the attachment attached thereto and extending upwardly therefrom.

The following descriptions of the preferred embodiments are not intended to limit the scope of the invention to the precise forms disclosed, but instead are intended to be illustrative of the principles of the invention so that others may follow its teachings.

Referring now to the drawings, FIGS. 1–6 and 13–14 illustrate a bookend assembled in accordance with the teachings of a first preferred embodiment of the present invention which is generally referred to by the reference numeral 10. As shown in FIGS. 1–6, the bookend 10 is shown secured to a conventional wooden bookshelf 12 having a front edge 14, a rear edge 16 (viewable in FIGS. 1–3), an upper surface 18, and a lower surface 20. As shown in FIGS. 1–6, the bookend 10 includes an upright 22, a base 24, a lower portion 26, a capture area 28 sized to receive the front edge 14 of the bookshelf 12, and a securement mechanism 30. The upright 22 preferably includes a pair of legs 32, 34, both of which extend upwardly from the base 24. Preferably, the legs 32, 34 of the upright 22 are joined at their upper ends 33, 35, respectively, by a cross-member 36. It will be understood that the upright 22 may alternatively be formed from a substantially solid panel or some sort of suitable framework as would be known to those skilled in the art.

Figures 4, 5:
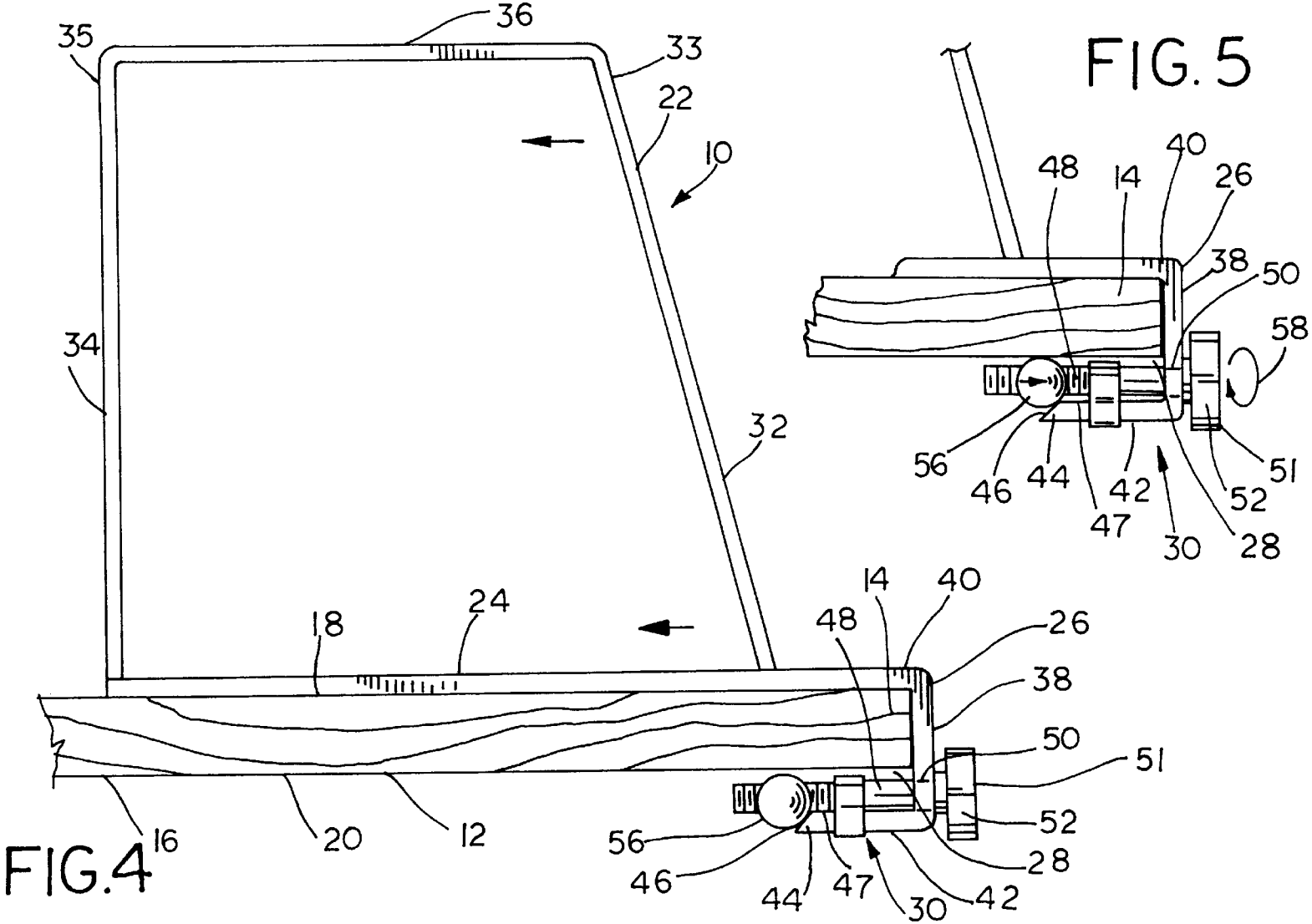
FIG. 4 is an elevational view of the bookend shown being attached to a bookshelf having a generally solid cross-section, such as would be found on a wooden bookshelf.
FIG. 5 is a fragmentary elevational view similar to FIG. 4 but showing the clamping mechanism being used to secure the bookend to the bookshelf.

Referring now to FIGS. 4 and 5, the lower portion 26 includes a vertical leg 38 which depends downwardly from a front portion 40 of the base 24. A horizontal leg 42 extends rearwardly from the vertical 38. The front portion 40 of the base 24 and the legs 38 and 42 cooperate to define the capture area 28. The horizontal leg 42 includes a free end 44 which preferably terminates in an angled or beveled surface 46. Alternatively, the entire horizontal leg 42 may be attached to the vertical leg 38 at an angle such that a top surface 47 of the leg 42 effectively forms the angled or beveled surface 46.

The securement mechanism 30 includes a threaded rod 48 which is disposed over the horizontal leg 42 and which protrudes through an aperture 50 (viewable in FIGS. 4 and 5) in the vertical leg 38. The threaded rod 48 includes a handle 51. Preferably, the handle 51 is manufactured so as to be easily graspable by a user. In the embodiment shown, the handle 51 is molded from a plastic material and has a plurality of indented grips 52. It will be understood however, that any number of suitable thumbscrews may be employed. The securement mechanism 30 also includes a wedge member 56 which threadingly engages the threaded rod 48. The wedge member 56 is sized to engage the beveled surface 46 at the end 44 of the horizontal leg 42, and is also sized to engage the lower surface 20 of the shelf 12 in response to rotation of the threaded rod 48 (such as is shown in FIGS. 1 and 5 in the direction indicated by the reference arrow 58). Accordingly, in response to rotation of the threaded rod 48, such as by turning the handle 51 in the clockwise direction 58 by a user, the wedge member 56 will be drawn to the right as is shown in FIG. 5. The resulting camming action thereby applies a progressively greater wedging force to the front edge 14 of the shelf 12, which secures the front edge 14 of the shelf 12 in the capture area 28. It will be understood that the bookend 10 may be removed therefrom simply by rotating the threaded rod 48 in the opposite direction.

Figures 6, 7, 8:
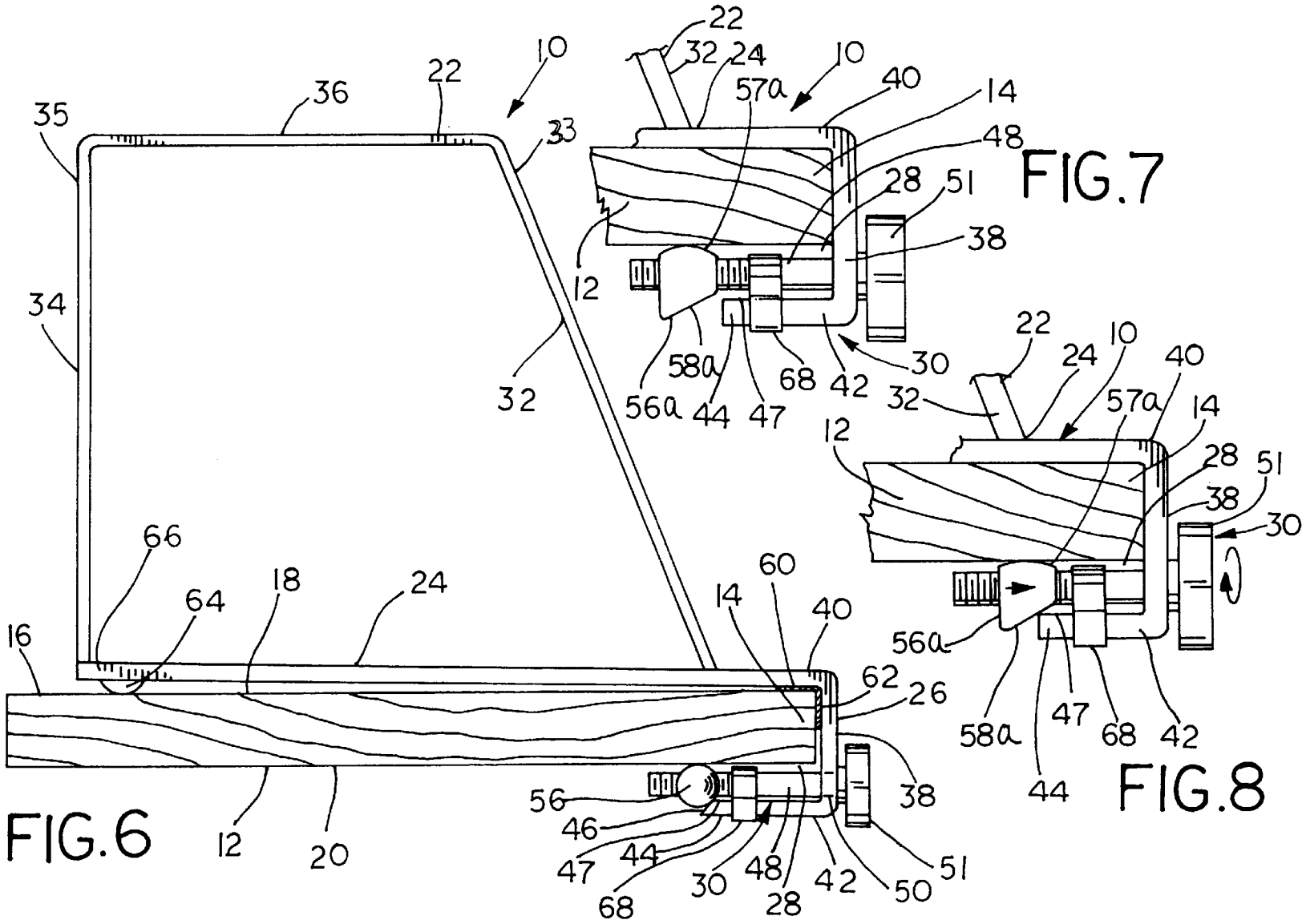
FIG. 6 is an elevational view similar to FIGS. 4 and 5 but showing optional resilient pads attached at the front and the rear of the bookend.
FIGS. 7 and 8 are fragmentary elevational views of optional wedge members assembled in accordance with the teachings of the present invention.

Referring now to FIG. 6, a pair of pads 60, 62 maybe disposed generally adjacent the intersection of the front portion 40 of the base 24 and the vertical leg 38. Similarly, a pad 64 maybe disposed between a rearward portion 66 of the base 24 and the upper surface 18 of the shelf 12. Preferably, the pads 60, 62 and 64 are resilient, and may therefore serve to prevent the bookend 10 from scratching or marring the finish of the bookshelf 12. Any type of resilient rubber, elastomeric material, compressible fibers, or any other suitable material may be employed for the pads. The pad 64 may further provide additional frictional resistance to the bottom of the base 24, such that the bookend 10 will resist twisting about a vertical axis.

Figure 14:
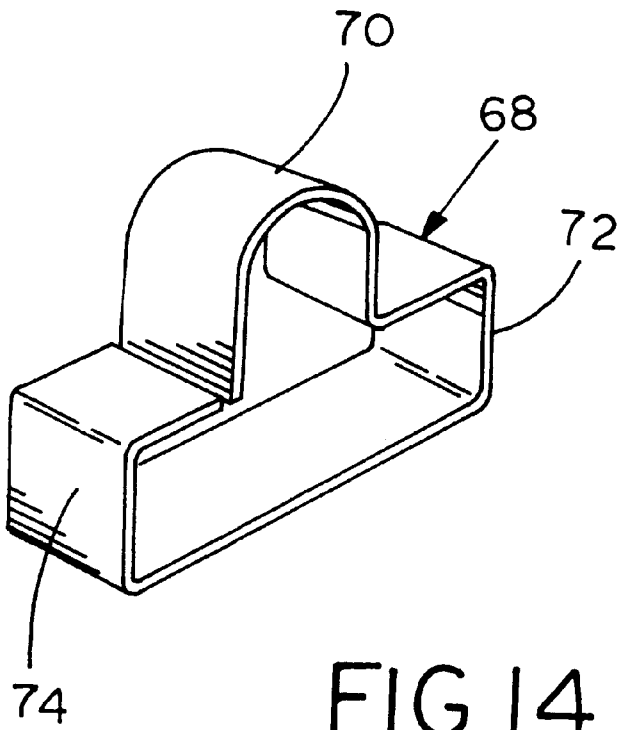
FIG. 14 is a perspective view of the centering clip shown in FIG. 13.
Figure 13:
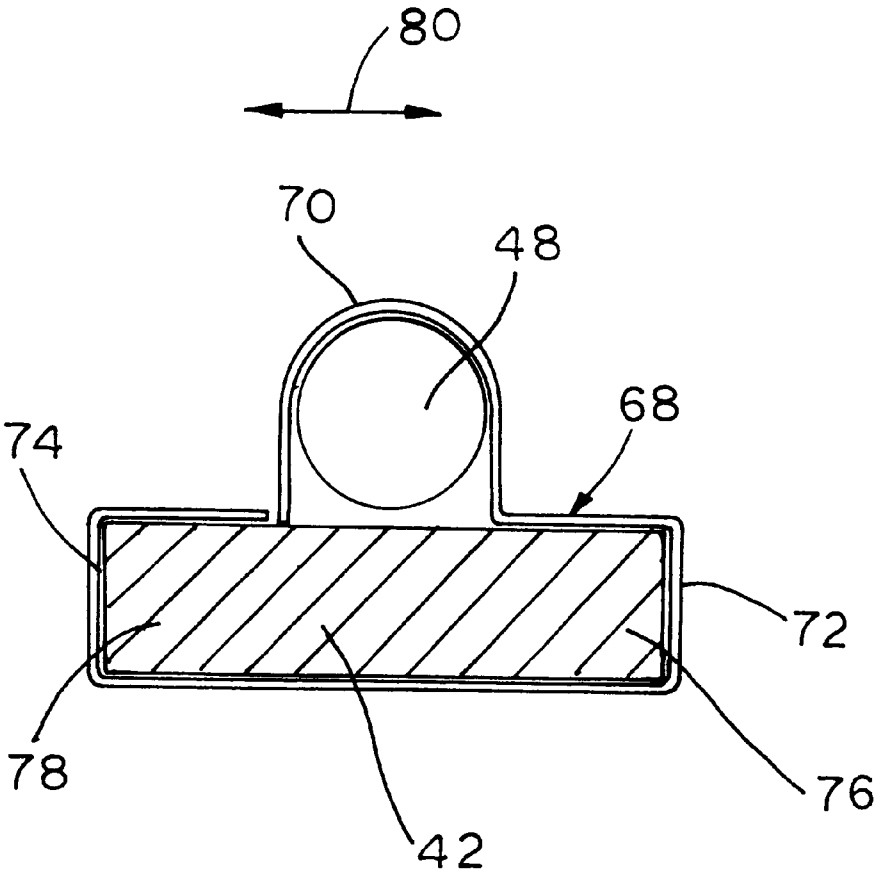
FIG. 13 is an elevational view of a centering clip.

Referring now to FIGS. 13 and 14, the securement mechanism 30 preferably includes a centering clip 68. The centering clip 68, which is preferably manufactured of spring steel or any other suitable material is sized to fit over the horizontal leg 42. The clip 68 includes a central arch or aperture 70 which is sized to receive therein the threaded rod 48 so as to permit free rotation of the threaded rod 48 relative to the clip 68. The aperture 70 is positioned to be roughly at the midpoint between opposing edges 72, 74 of the clip 68. The edges 72, 74 of the clip 68 are sized to frictionally engage the corresponding edge portions 76, 78 of the horizontal leg 42. Accordingly, the clip 68 serves to prevent the threaded rod 48 and the attached wedge member 56 from "migrating" back and forth in the transverse direction indicated by the reference numeral 80 relative to the horizontal leg 42 in response to rotation of the threaded rod 48. Alternatively, a pair of pins disposed on each side of the threaded rod may be employed.

In operation, the bookend 10 is placed adjacent the front edge 14 of the shelf 12 in the manner shown in FIG. 4. By turning the handle 51 in the desired direction 58, the wedge member 56 cams against the surface 146 and is pushed upwardly against the lower surface 20 of the shelf 12, so that the securement mechanism 30 will be shifted toward the position shown in FIG. 5. Consequently, the front edge 14 of the shelf 12 is wedged within the capture area 28. The bookend 10 is thus firmly secured to the shelf 12.

Referring again to FIGS. 1–3, the bookend 10 may include an optional extender plate 82. Preferably, the plate 82 includes a base 84 having an aperture 86, which is alignable with a corresponding aperture 88 in the crossmember 36 of the upright 22. A screw, bolt, or any other suitable fastener may be used to secure the plate 82 to the upright 22. The plate 82 may be attached to the upright 22 in an upwardly extending position, such as that shown in FIG. 2, so that the bookend 10 may be used to support relatively tall books (not shown). Alternatively, the plate 82 may be secured to the upright 22 in a downwardly extending position such as that shown in FIG. 3, such that the plate 82 prevents relatively short books (not shown) from falling through the upright 22.

Referring now to FIGS. 7 and 8, an alternate form for the wedge member 56 is shown therein which is referred to by the reference numeral 56*a*. The wedge member 56*a* includes a top surface 57*a* and a bottom surface 58*a*. The bottom surface 58*a* is preferably angled such that the bottom surface 58*a* forms a camming surface. It will be noted in FIGS. 7 and 8 that the rearward end 44 of the horizontal leg 42 need not have an angled or beveled surface, the camming action being accounted for by the angled bottom surface 58*a* of the wedge member 56*a*. All other components of the clamping mechanism 30 and the lower portion 26 of the bookend 10 are substantially as explained in the above paragraphs and need not be described further herein.

In response to rotation of the threaded rod 48, the wedge member 56*a* is drawn to the right when viewing FIGS. 7 and 8, such that the angled camming surface 58*a* cams against the horizontal leg 44, thereby securing the bookend 10 to the shelf 12 by applying a progressively greater wedging force to the front edge 14 of the bookshelf 12.

Figures 9, 10:
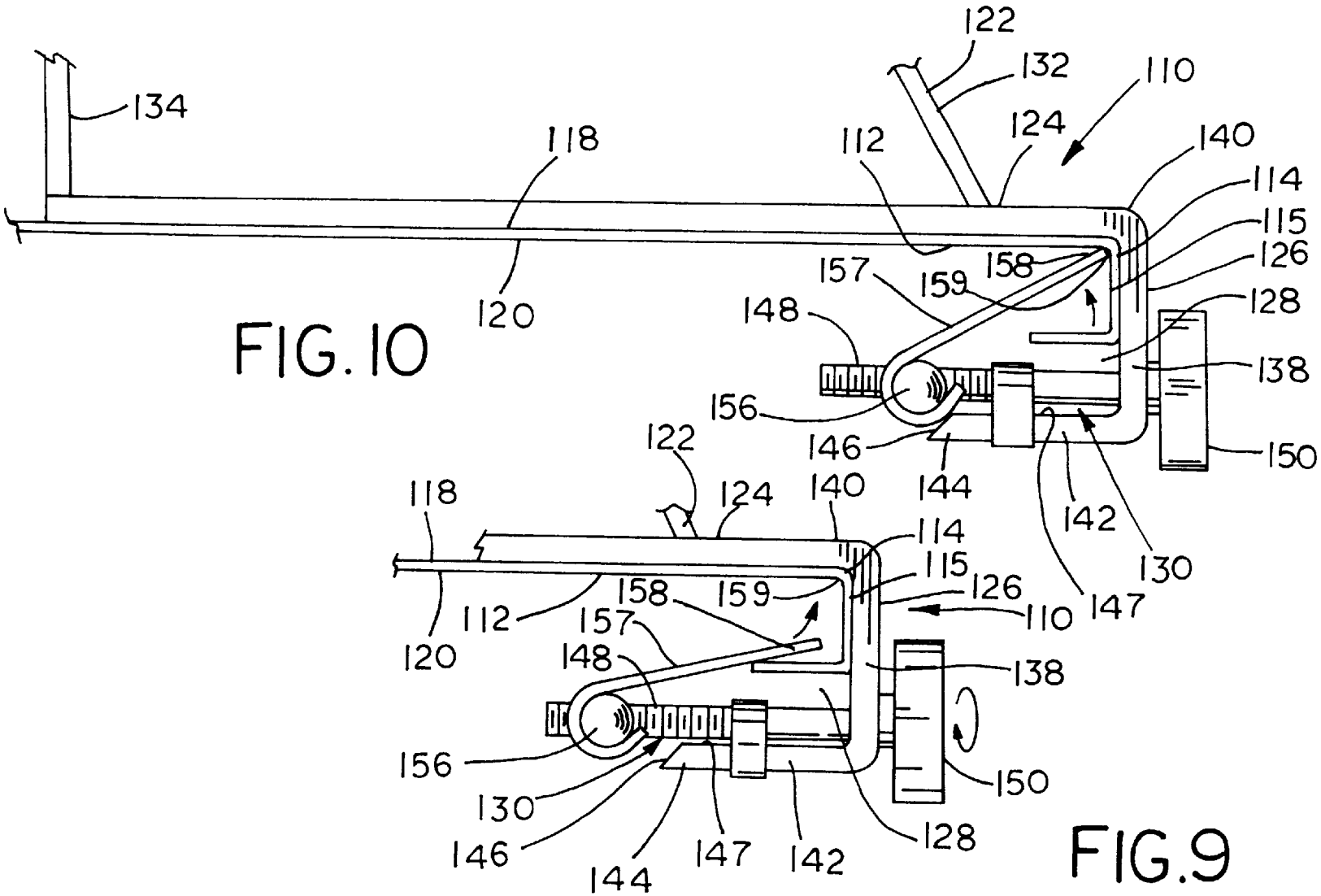
FIG. 9 is a fragmentary elevational view of a bookend assembled in accordance with the teachings of a second embodiment of the present invention and shown being attached to a metal bookshelf.
FIG. 10 is an elevational view similar to FIG. 9 showing the bookend secured to the bookshelf.

Referring now to FIGS. 9 and 10, a bookend assembled in accordance with the teachings of a second preferred embodiment is generally referred to by the reference numeral 110 and is shown attached to a metal bookshelf 112 having a front edge 114 having a flange or lip 15 such that the bookshelf 112 has a non-solid cross-section. The shelf 112 includes an upper surface 118 and a lower surface 120. The bookend 110 includes an upright 122, a base 124, a lower portion 126, a capture area 128 sized to receive the front edge 114 of the bookshelf 112, and a securement mechanism 130. The upright 122 preferably includes a pair of legs 132, 134, both of which extend upwardly from the base 124.

The lower portion 126 includes a vertical leg 138 which depends downwardly from a front portion 140 of the base 124. A horizontal leg 142 extends rearwardly from the vertical leg 138. The front portion 140 of the base 124 and the legs 138 and 142 cooperate to define the capture area 128. The horizontal leg 142 includes a free end 144 which preferably terminates in an angled or beveled surface 146. A threaded rod 148 which is disposed over the horizontal leg 142 and protrudes through an aperture in the vertical leg 138. The threaded rod 148 includes a handle 150. The securement mechanism 130 also includes a cylindrical member 156 which threadingly engages the threaded rod 148. An arm 157 having a free end 158 is rotatably mounted to the member 156, with the free end 158 positioned to engage the intersection or vertex 159 between the front portion 114 of the shelf 112 and the flange 115. The member 156 is sized to engage the beveled surface 146 at the end 144 of the horizontal leg 142. In response to rotation of the threaded rod 148 such as by turning the handle 150, the member 156 will be drawn to the right such that the free end 158 seeks the vertex 159 while the member 156 cams against the surface 146, such that a progressively greater wedging force is applied to the shelf 112.

Figure 11:
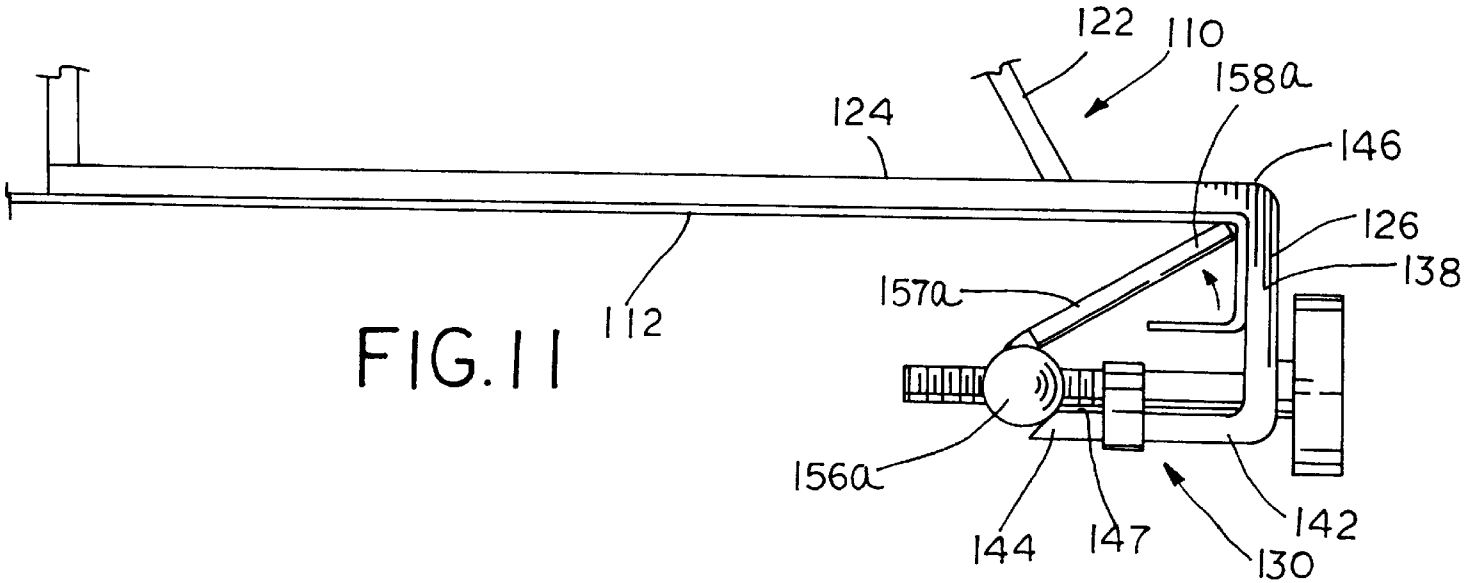
FIGS. 11 and 12 are fragmentary elevational views of optional wedge members assembled in accordance with the teachings of the present invention.

Referring now to FIG. 11, an alternate form for the member 156 of the clamping mechanism 130 is shown therein which is referred to by the reference numeral 156*a*. The member 156*a* includes an arm 157*a* having a free end 158*a*. The arm 157*a* is fixed relative to the member 156*a*. All other components of the clamping mechanism 130 and the lower portion 126 of the bookend 110 may be substantially as explained in the above paragraphs and need not be described further herein.

Figure 12:
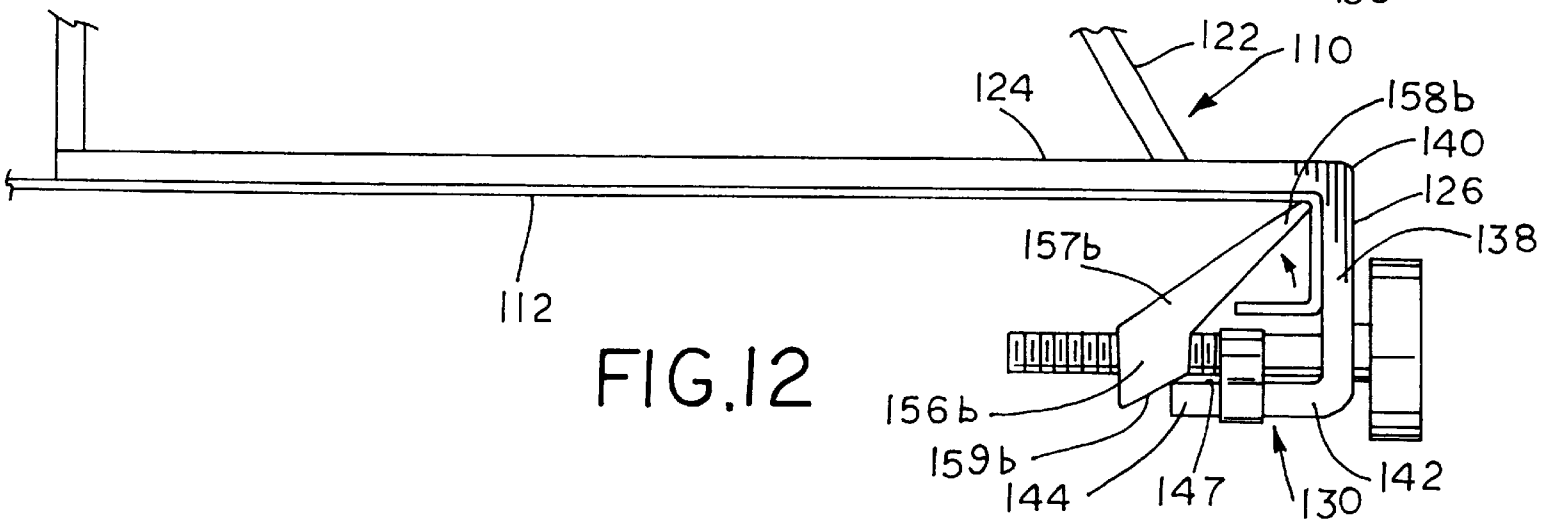

Referring now to FIG. 12, another alternate form for the member 156 of the clamping mechanism 130 is shown therein which is referred to by the reference numeral 156*b*. The member 156*b* includes an arm 157*b* having a free end 158*b* and including an angled camming surface 159*b*. It will be noted that the free end 144 of the horizontal leg 142 is not beveled or angled, and that the arm 157*b* is fixed relative to the member 156*b*. All other components of the clamping mechanism 130 and the lower portion 126 of the bookend 110 may be substantially as explained in the above paragraphs and need not be described further herein.

Those skilled in the art will appreciate that, although the teachings of the invention have been illustrated in connection with certain embodiments, there is no intent to limit the invention to such embodiments. On the contrary, the intention of this application is to cover all modifications and embodiments fairly falling within the scope of the appended claims either literally or under the doctrine of equivalents.

What is claimed:

1. A bookend for use with a bookshelf, the bookshelf having an upper surface, a lower surface, and being bounded in part by a front edge portion, the bookend comprising:

an upright;

a base supporting the upright and adapted for placement generally adjacent the bookshelf upper surface;

a lower portion depending from the base, the lower portion cooperating with the base to define a capture area, the capture area being sized to receive therein the bookshelf front edge portion; and an adjustable securement mechanism mounted to the lower portion and including a movable member, the movable member arranged to move into and out of the capture area from below the capture area in response to adjustment of the securement mechanism, the movable member further arranged to move horizontally in response to adjustment of the securement mechanism, the securement mechanism being adapted to secure the bookshelf front edge portion in the capture area, whereby the bookend may be secured to the bookshelf.

2. A bookend for use with a bookshelf, the bookshelf having an upper surface, a lower surface, and being bounded in part by a front edge portion, the bookend comprising:

an upright;

a base supporting the upright and adapted for placement generally adjacent the bookshelf upper surface;

a lower portion depending from the base, the lower portion cooperating with the base to define a capture area, the capture area being sized to receive therein the bookshelf front edge portion;

an adjustable securement mechanism mounted to the lower portion and including a movable member, the movable member arranged to move into and out of the capture area from below the capture area in response to adjustment of the securement mechanism, the securement mechanism being adapted to secure the bookshelf front edge portion in the capture area, whereby the bookend may be secured to the bookshelf; and wherein the securement mechanism includes a threaded rod rotatably mounted to the lower portion, the securement mechanism being responsive to rotation of the threaded rod to thereby permit the application of a progressively greater force against the bookshelf front edge portion, and further wherein the securement mechanism includes a wedge member operatively coupled to the threaded rod.

3. The bookend of claim 2, wherein the threaded rod is secured to the lower portion by a clip.

4. The bookend of claim 3, wherein the clip includes an aperture sized to receive a portion of the threaded rod.

5. The bookend of claim 2, including a plate member removably attached to the upright, the plate member being attachable in a first position in which the plate member extends upwardly away from the base, the plate member further being attachable in a second position in which the plate member extends downwardly toward the base.

6. A bookend for use with a bookshelf, the bookshelf having an upper surface, a lower surface, and being bounded in part by a front edge portion, the bookend comprising:

an upright mounted to a base;

the base adapted for placement generally adjacent the bookshelf upper surface;

a lower portion depending from the base, the lower portion cooperating with the base to define a capture area, the capture area being sized to receive therein the bookshelf front edge portion, the lower portion including a first leg and a second leg, at least a portion of the second leg defining a camming surface; and an adjustable securement mechanism mounted to the lower portion, the securement mechanism being adapted to secure the bookshelf front edge portion in the capture area, whereby the bookend may be secured to the bookshelf, and wherein the securement mechanism includes a threaded rod rotatably mounted to the first leg and a wedge member engaging the threaded rod, the wedge member being sized to coact with the camming surface in response to rotation of the threaded rod to thereby apply a progressively greater force against the bookshelf.

7. The bookend of claim 6, wherein the lower portion includes a pad positioned to contact the bookshelf front edge portion.

8. A bookend for use with a bookshelf, the bookshelf having an upper surface, a lower surface, and being bounded in part by a front edge portion, the bookend comprising:

an upright;

a base supporting the upright and adapted for placement generally adjacent the bookshelf upper surface;

a lower portion depending from the base, the lower portion cooperating with the base to define a capture area, the capture area being sized to receive therein the bookshelf front edge portion; and an adjustable securement mechanism mounted to the lower portion, the securement mechanism being adapted to secure the bookshelf front edge portion in the capture area, and wherein the lower portion includes a camming surface and the securement mechanism includes an adjustable wedge member, the wedge member being positioned to engage the camming surface to thereby permit the application of a variable force against the bookshelf in response to adjustment of the securement mechanism.

9. The bookend of claim 8, wherein the base includes a pad positioned to contact the bookshelf upper surface.

10. A bookend for use with a bookshelf, the bookshelf having an upper surface, a lower surface, and being bounded in part by a front edge portion, the bookend comprising:

an upright;

a base supporting the upright and adapted for placement generally adjacent the bookshelf upper surface;

a lower portion depending from the base, the lower portion cooperating with the base to define a capture area, the capture area being sized to receive therein the bookshelf front edge portion; and an adjustable securement mechanism mounted to the lower portion and including a movable member, the movable member arranged to move into and out of the capture area from below the capture area in response to adjustment of the securement mechanism, the securement mechanism being adapted to secure the bookshelf front edge portion in the capture area, whereby the bookend may be secured to the bookshelf, wherein the lower portion and the base cooperate to define an interior corner, and wherein the securement mechanism includes a wedge member having an extending portion adapted to extend upwardly from the wedge member toward the interior corner.

11. The bookend of claim 10, the securement mechanism further including a threaded rod rotatably mounted to the lower portion, the wedge member being movable in response to rotation of the threaded rod, thereby permitting the wedge member extending portion to move progressively toward or away from the interior corner in response to rotation of the threaded rod.

12. A bookend for use with a bookshelf, the bookshelf having an upper surface, a lower surface, and being bounded in part by a front edge portion, the bookend comprising:

an upright mounted to a base;

the base adapted for placement generally adjacent the bookshelf upper surface;

a lower portion depending from the base, the lower portion cooperating with the base to define a capture area having an interior corner, the capture area being sized to receive therein the bookshelf front edge portion; and an adjustable securement mechanism mounted to the lower portion, the securement mechanism including a wedge member having an extending portion being adapted to adapted to extend upwardly from the wedge member toward the interior corner, the securement mechanism adapted to secure the bookshelf front edge portion in the capture area, the securement mechanism further including a threaded rod rotatably mounted to the lower portion, the wedge member being moveable in response to rotation of the threaded rod, thereby permitting the wedge member extending portion to move progressively toward or away from the interior corner in response to rotation of the threaded rod, and wherein the wedge member includes a threaded portion engaging the threaded rod, the extending portion mounted to the threaded portion so as to be shiftable relative to the threaded portion.

13. A bookend for use with a bookshelf, the bookshelf having an upper surface, a lower surface, and being bounded in part by a front edge portion, the bookend comprising:

an upright;

a base supporting the upright and adapted for placement generally adjacent the bookshelf upper surface;

a lower portion depending from the base, the lower portion cooperating with the base to define a capture area having an interior corner, the capture area being sized to receive therein the bookshelf front edge portion; and an adjustable securement mechanism mounted to the lower portion, the securement mechanism including a wedge member having an extending portion being adapted to adapted to extend upwardly from the wedge member toward the interior corner, the securement mechanism adapted to secure the bookshelf front edge portion in the capture area, the securement mechanism further including a threaded rod rotatably mounted to the lower portion, the wedge member being moveable in response to rotation of the threaded rod, thereby permitting the wedge member extending portion to move progressively toward or away from the interior corner in response to rotation of the threaded rod, and wherein the wedge member includes a cylindrical threaded portion, the extending portion pivotally mounted to the cylindrical threaded portion.

14. A bookend for use with a bookshelf, the bookshelf having an upper surface, a lower surface, and being bounded in part by a front edge portion, the bookend comprising:

a frame, the frame including a first portion adapted to overlie the bookshelf upper surface, the frame further including a second portion depending from the first portion, the first and second portions cooperating to define a capture area, the capture area being sized to receive therein the bookshelf front edge portion, at least a portion of the second portion defining a camming surface;

a threaded rod rotatably mounted to the frame; and a wedge member adapted to engage the threaded rod, the wedge member being movable toward the capture area in response to rotation of the threaded rod, thereby permitting the bookshelf front edge portion to be secured in the capture area.

15. The bookend of claim 14, wherein the threaded rod is rotatably mounted to the frame second portion.

16. The bookend of claim 14, wherein the frame second portion includes a camming surface, and wherein the wedge member coacts with the camming surface, thereby progressively urging the wedge member upwardly toward the frame first part in response to rotation of the threaded rod.

17. The bookend of claim 14, wherein the threaded rod includes a handle.

18. The bookend of claim 14, wherein the frame includes at least one resilient pad positioned to contact the bookshelf.

19. The bookshelf of claim 18, wherein the frame first portion includes at least one resilient pad positioned to contact the bookshelf upper surface, and further wherein the frame second portion includes at least one resilient pad positioned to contact the bookshelf front edge portion.

20. The bookend of claim 14, including a centering clip engaging the threaded rod.

21. The bookend of claim 20, wherein the centering clip comprises spring steel and is sized to engage a portion of the frame.

22. The bookend of claim 14, including an upright mounted to the frame first portion and extending upwardly away from the frame first portion, and further including a plate member adapted for attachment to the upright in either of a first position or a second position, the plate member when in the first position extending upwardly away from the frame first portion, the plate member when in the second position extending downwardly toward the frame first portion.

23. A bookend for use with a bookshelf, the bookshelf having an upper surface, a lower surface, and being bounded in part by a front edge, the bookend comprising:

a frame, the frame including a first portion adapted to overlie the bookshelf upper surface, a second portion depending from the first portion, the first and second portions cooperating to define a capture area, the capture area being sized to receive therein the bookshelf front edge portion, the second portion including a camming surface;

a securement mechanism including a threaded rod rotatably mounted to the frame and a wedge member adapted to engage the threaded rod, the securement mechanism cooperating with the camming surface so as to progressively urge the wedge member further into the capture area in response to rotation of the threaded rod, thereby permitting securement of the bookend to the bookshelf.

* * * * *